US010060630B2

(12) United States Patent
Stuttaford et al.

(10) Patent No.: US 10,060,630 B2
(45) Date of Patent: Aug. 28, 2018

(54) FLAMESHEET COMBUSTOR CONTOURED LINER

(71) Applicant: ANSALDO ENERGIA IP UK LIMITED, London (GB)

(72) Inventors: Peter John Stuttaford, Jupiter, FL (US); Hany Rizkalla, Stuart, FL (US)

(73) Assignee: ANSALDO ENERGIA IP UK LIMITED (GB)

( * ) Notice: Subject to any disclaimer, the term of this patent is extended or adjusted under 35 U.S.C. 154(b) by 797 days.

(21) Appl. No.: 14/549,922

(22) Filed: Nov. 21, 2014

(65) Prior Publication Data

US 2015/0075172 A1 Mar. 19, 2015

Related U.S. Application Data

(63) Continuation-in-part of application No. 14/038,064, filed on Sep. 26, 2013.

(60) Provisional application No. 61/708,323, filed on Oct. 1, 2012.

(51) Int. Cl.

| | |
|---|---|
| ***F23R 3/54*** | (2006.01) |
| ***F23R 3/14*** | (2006.01) |
| ***F23R 3/16*** | (2006.01) |
| ***F23R 3/28*** | (2006.01) |
| ***F23R 3/34*** | (2006.01) |

(52) U.S. Cl.

CPC ..... *F23R 3/54* (2013.01); *F23R 3/14* (2013.01); *F23R 3/16* (2013.01); *F23R 3/286* (2013.01); *F23R 3/34* (2013.01); *F23R 3/343* (2013.01); *F23C 2201/20* (2013.01); *F23C 2900/06043* (2013.01); *F23C 2900/07001* (2013.01); *F23R 2900/00014* (2013.01); *F23R 2900/03343* (2013.01)

(58) Field of Classification Search

CPC ..... F23R 3/54; F23R 3/16; F23R 3/14; F23R 3/26; F23R 3/286; F23R 3/34; F23R 3/343; F23R 3/60; F23C 2201/20; F23C 2900/06043; F23C 2900/07001; F23C 2900/00014; F23C 2900/03343

See application file for complete search history.

(56) References Cited

U.S. PATENT DOCUMENTS

| | | | |
|---|---|---|---|
| 3,759,038 | A | 9/1973 | Scalzo et al. |
| 4,910,957 | A | 3/1990 | Moreno et al. |
| 4,928,481 | A | 5/1990 | Joshi et al. |
| 5,129,226 | A | 7/1992 | Bigelow |
| 5,319,935 | A | 6/1994 | Toon et al. |

(Continued)

FOREIGN PATENT DOCUMENTS

| | | |
|---|---|---|
| EP | 0747635 | 12/1996 |

OTHER PUBLICATIONS

International Search Report with Written Opinion dated Jun. 27, 2014 in PCT Application No. PCT/US2013/062678, 11 pages.

(Continued)

*Primary Examiner* — Craig Kim
(74) *Attorney, Agent, or Firm* — Hovey Williams LLP

(57) ABSTRACT

The present invention discloses a novel apparatus and way for reducing the recirculation zone at the inlet end of a combustor. The recirculation zone is reduced by altering the geometry of the inlet end through a tapering of the liner wall thickness and a tapering of the thermal barrier coating to reduce the bluff body effect at the combustion liner inlet end.

21 Claims, 8 Drawing Sheets

(56) References Cited

U.S. PATENT DOCUMENTS

| | | | | |
|---|---|---|---|---|
| 5,452,574 | A | 9/1995 | Cowell et al. | |
| 5,584,684 | A | 12/1996 | Doebbeling et al. | |
| 5,619,855 | A * | 4/1997 | Burrus | F23R 3/02 60/262 |
| 5,676,538 | A | 10/1997 | Lovett | |
| 5,802,854 | A | 9/1998 | Maeda et al. | |
| 5,983,642 | A | 11/1999 | Parker | |
| 6,056,538 | A | 5/2000 | Buechner et al. | |
| 6,094,916 | A | 8/2000 | Puri et al. | |
| 6,408,610 | B1 * | 6/2002 | Caldwell | C23C 14/046 29/889.2 |
| 6,513,334 | B2 | 2/2003 | Varney | |
| 6,634,175 | B1 | 10/2003 | Kawata et al. | |
| 7,093,445 | B2 | 8/2006 | Corr, II et al. | |
| 7,216,485 | B2 * | 5/2007 | Caldwell | F23R 3/06 29/889.721 |
| 7,373,778 | B2 | 5/2008 | Bunker et al. | |
| 7,540,152 | B2 | 6/2009 | Tanimura et al. | |
| 7,581,402 | B2 * | 9/2009 | Parker | F23R 3/283 60/748 |
| 7,770,395 | B2 | 8/2010 | Tanimura et al. | |
| 7,886,545 | B2 | 2/2011 | Lacy et al. | |
| 8,448,444 | B2 | 5/2013 | Cihlar et al. | |
| 8,656,721 | B2 | 2/2014 | Matsumoto et al. | |
| 2004/0006993 | A1 | 1/2004 | Stuttaford et al. | |
| 2007/0089419 | A1 | 4/2007 | Matsumoto et al. | |
| 2008/0083224 | A1 | 4/2008 | Varatharajan et al. | |
| 2009/0111063 | A1 | 4/2009 | Boardman | |
| 2009/0280298 | A1 * | 11/2009 | Rosenzweig | C23C 30/00 428/156 |
| 2010/0319349 | A1 | 12/2010 | Rajaram et al. | |
| 2010/0319350 | A1 | 12/2010 | Landry et al. | |
| 2010/0326079 | A1 | 12/2010 | Zuo et al. | |
| 2011/0016867 | A1 | 1/2011 | Milosavljevic | |
| 2011/0067402 | A1 | 3/2011 | Wiebe et al. | |
| 2011/0094233 | A1 | 4/2011 | Kashihara et al. | |
| 2011/0113784 | A1 | 5/2011 | Headland et al. | |
| 2011/0185703 | A1 | 8/2011 | Dodo et al. | |
| 2011/0296839 | A1 | 12/2011 | Van Nieuwenhuizen et al. | |
| 2012/0045725 | A1 | 2/2012 | Takiguchi et al. | |
| 2012/0047897 | A1 | 3/2012 | Hirata et al. | |
| 2012/0186256 | A1 | 7/2012 | Dai et al. | |
| 2014/0090389 | A1 | 4/2014 | Stuttaford et al. | |
| 2014/0090390 | A1 | 4/2014 | Stuttaford et al. | |
| 2014/0090396 | A1 | 4/2014 | Stuttaford et al. | |
| 2014/0090400 | A1 | 4/2014 | Stuttaford et al. | |
| 2015/0184856 | A1 | 7/2015 | Stuttaford et al. | |
| 2015/0184858 | A1 | 7/2015 | Stuttaford et al. | |
| 2015/0241063 | A1 * | 8/2015 | Bangerter | F23R 3/002 60/754 |

OTHER PUBLICATIONS

Non-Final Office Action dated Sep. 23, 2015 in U.S. Appl. No. 14/038,016, 20 pages.

Notice of Allowance dated Jan. 20, 2016 in U.S. Appl. No. 14/038,016, 9 pages.

Non-Final Office Action dated Feb. 11, 2016 in U.S. Appl. No. 14/038,038, 10 pages.

Non-Final Office Action dated Mar. 24, 2016 in U.S. Appl. No. 14/038,070, 20 pages.

Non-Final Office Action dated Mar. 25, 2016 in U.S. Appl. No. 14/038,064, 14 pages.

Non-Final Office Action dated May 2, 2016 in U.S. Appl. No. 14/038,056, 10 pages.

Non-Final Office Action dated May 16, 2016 in U.S. Appl. No. 14/038,029, 14 pages.

* cited by examiner

FLAMESHEET COMBUSTOR CONTOURED LINER

CROSS-REFERENCE TO RELATED APPLICATIONS

This application is a continuation-in-part of U.S. patent application Ser. No. 14/038,064, filed on Sep. 26, 2013, which claims priority to U.S. Provisional Patent Application Ser. No. 61/708,323 filed on Oct. 1, 2012.

TECHNICAL FIELD

The present invention relates generally to an apparatus and method for directing a fuel-air mixture into a combustion system. More specifically, a hemispherical dome is positioned proximate an inlet to a combustion liner to direct the fuel-air mixture in a more effective way to better control the velocity of the fuel-air mixture entering the combustion liner while minimizing the adverse aerodynamic effects at a combustion liner inlet region.

BACKGROUND OF THE INVENTION

In an effort to reduce the amount of pollution emissions from gas-powered turbines, governmental agencies have enacted numerous regulations requiring reductions in the amount of oxides of nitrogen (NOx) and carbon monoxide (CO). Lower combustion emissions can often be attributed to a more efficient combustion process, with specific regard to fuel injector location, airflow rates, and mixing effectiveness.

Early combustion systems utilized diffusion type nozzles, where fuel is mixed with air external to the fuel nozzle by diffusion, proximate the flame zone. Diffusion type nozzles historically produce relatively high emissions due to the fact that the fuel and air burn essentially upon interaction, without mixing, and stoichiometrically at high temperature to maintain adequate combustor stability and low combustion dynamics.

An alternate means of premixing fuel and air and obtaining lower emissions can occur by utilizing multiple combustion stages. In order to provide a combustor with multiple stages of combustion, the fuel and air, which mix and burn to form the hot combustion gases, must also be staged. By controlling the amount of fuel and air passing into the combustion system, available power as well as emissions can be controlled. Fuel can be staged through a series of valves within the fuel system or dedicated fuel circuits to specific fuel injectors. Air, however, can be more difficult to stage given the large quantity of air supplied by the engine compressor. In fact, because of the general design to gas turbine combustion systems, as shown by FIG. 1, air flow to a combustor is typically controlled by the size of the openings in the combustion liner itself, and is therefore not readily adjustable. An example of the prior art combustion system 100 is shown in cross section in FIG. 1. The combustion system 100 includes a flow sleeve 102 containing a combustion liner 104. A fuel injector 106 is secured to a casing 108 with the casing 108 encapsulating a radial mixer 110. Secured to the forward portion of the casing 108 is a cover 112 and pilot nozzle assembly 114.

However, while premixing fuel and air prior to combustion has been shown to help lower emissions, the amount of fuel-air premixture being injected has a tendency to vary due to a variety of combustor variables. As such, obstacles still remain with respect to controlling the amount of a fuel-air premixture being injected into a combustor.

SUMMARY

The present invention discloses an apparatus and method for improving control of the fuel-air mixing prior to injection of the mixture into a combustion liner of a multi-stage combustion system. More specifically, in an embodiment of the present invention, a gas turbine combustor is provided having a generally cylindrical flow sleeve and a generally cylindrical combustion liner contained therein. The gas turbine combustor also comprises a set of main fuel injectors and a combustor dome assembly encompassing the inlet end of a combustion liner and having a generally hemispherical cross section. The dome assembly extends both axially towards the set of main fuel injectors and within the combustion liner to form a series of passageways through which a fuel-air mixture passes, where the passageways are sized accordingly to regulate the flow of the fuel-air premixture.

In an alternate embodiment of the present invention, a dome assembly for a gas turbine combustor is disclosed. The dome assembly comprises an annular, hemispherical-shaped cap extending about the axis of the combustor, an outer annular wall secured to a radially outer portion of the hemispherical-shaped cap and an inner annular wall also secured to a radially inner portion of the hemispherical-shaped cap. The resulting dome assembly has a generally U-shaped cross section sized to encompass an inlet portion of a combustion liner.

In yet another embodiment of the present invention, a method of controlling a velocity of a fuel-air mixture for a gas turbine combustor is disclosed. The method comprises directing a fuel-air mixture through a first passageway located radially outward of a combustion liner and then directing the fuel-air mixture from the first passageway through a second passageway located adjacent to the first passageway. The fuel-air mixture is then directed from the second passageway and through a fourth passageway formed by a hemispherical dome cap, thereby causing the fuel-air mixture to reverse direction. The fuel-air mixture then passes through a third passageway that is located within the combustion liner.

In yet another embodiment of the present invention, a generally annular body is provided having thickness, an inlet end, an opposing outlet end, an inner surface, and an opposing outer surface, where the outer surface has a contoured profile proximate the inlet end such that the outer surface comprises a first outer surface and a second outer surface with the first outer surface located radially outward of the second outer surface and a first chamfer extending from the first outer surface to the inlet end. A thermal barrier coating is applied to the inner surface where a portion of the coating proximate the inlet end has a second chamfer thereby tapering a coating thickness towards the inlet end.

In another embodiment of the present invention, an inlet portion of a combustion liner is provided comprising a generally annular body tapering from a first liner thickness, having a second liner thickness, and tapering from a first liner thickness at a first rate proximate an inlet end. A coating is applied to an inner wall of the generally annular body, the coating tapering from a first coating thickness to a second coating thickness at the inlet end, the coating tapering at a second rate.

In yet another embodiment of the present invention, a method of reducing a recirculation zone in a combustion liner is provided. A combustion liner is provided having a chamfer along an outer surface of the combustion liner, a coating applied to an inner surface of the combustion liner, and a chamfer to the coating on the inner surface. A fuel and air mixture is directed along the outer surface of the combustion liner and turned about an inlet end of the combustion liner such that the mixture remains at least in close proximity to the chamfered portions of the combustion liner and is then directed into the combustion liner.

In yet another alternate embodiment of the present invention, a combustion liner is provided comprising a generally annular body having thickness, an inlet end, an opposing outlet end, an inner surface, and an opposing outer surface, where the outer surface has a contoured profile having a first radius. A thermal barrier coating is applied to the inner surface where a portion of the coating proximate the inlet end has a chamfer, thereby tapering a coating thickness towards the inlet end of the combustion liner.

In another alternate embodiment of the present invention, a combustion liner is provided comprising a generally annular body having thickness, an inlet end, an opposing outlet end, an inner surface, and an opposing outer surface, where the outer surface has a chamfered profile towards an inlet end of the combustion liner. A thermal barrier coating is applied to the inner surface where a portion of the coating proximate the inlet end has a contoured profile having a first radius thereby tapering a coating thickness towards the inlet end of the combustion liner.

In yet another alternate embodiment of the present invention, a combustion liner is provided comprising a generally annular body having thickness, an inlet end, an opposing outlet end, an inner surface, and an opposing outer surface, where the outer surface has a contoured profile having a first radius. A thermal barrier coating is applied to the inner surface where a portion of the coating proximate the inlet end has a second radius thereby tapering a coating thickness towards the inlet end.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

By way of reference, this application incorporates the subject matter of U.S. Pat. Nos. 6,935,116, 6,986,254, 7,137,256, 7,237,384, 7,308,793, 7,513,115, and 7,677,025.

The present invention discloses a system and method for controlling velocity of a fuel-air mixture being injected into a combustion system. That is, a predetermined effective flow area is maintained through two co-axial structures forming an annulus of a known effective flow area through which a fuel-air mixture passes.

Figure 1:
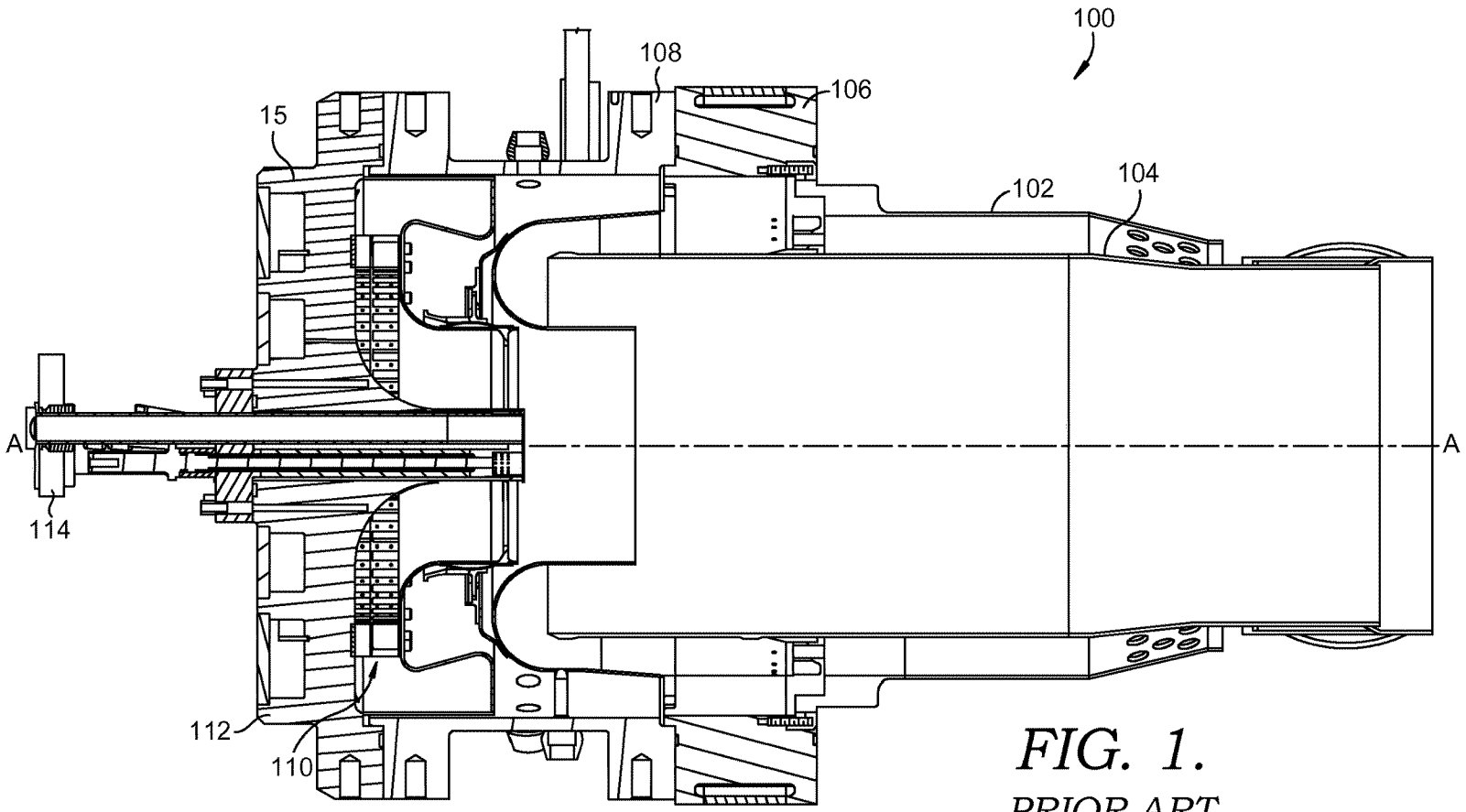
FIG. 1. PRIOR ART
FIG. 1 is a cross section of a combustion system of the prior art.
Figure 2:
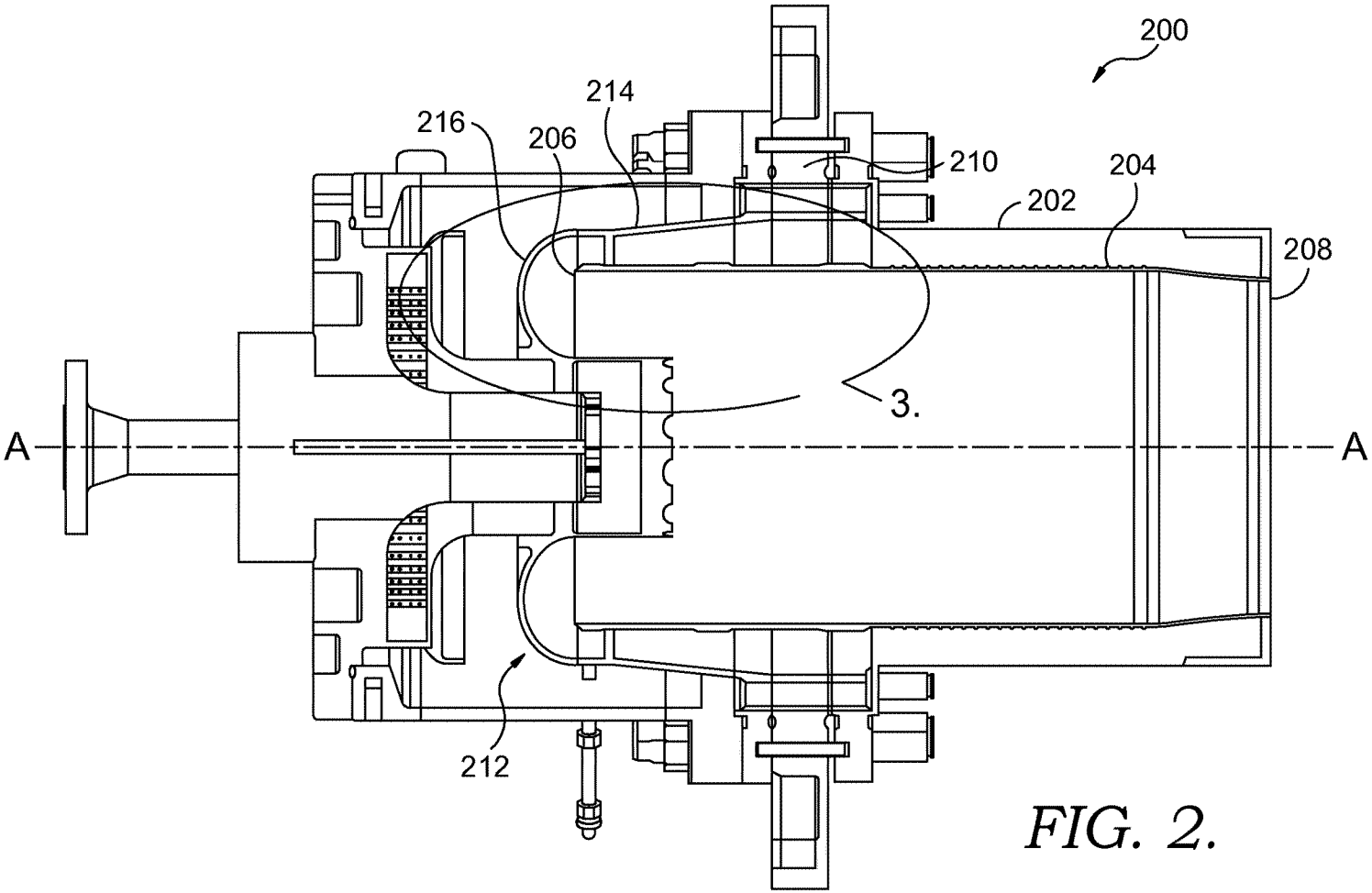
FIG. 2 is a cross section of a gas turbine combustor in accordance with an embodiment of the present invention.

The present invention will now be discussed with respect to FIGS. 2-8. An embodiment of a gas turbine combustion system 200 in which the present invention operates is depicted in FIG. 2. The combustion system 200 is an example of a multi-stage combustion system and extends about a longitudinal axis A-A and includes a generally cylindrical flow sleeve 202 for directing a predetermined amount of compressor air along an outer surface of a generally cylindrical and co-axial combustion liner 204. The combustion liner 204 has an inlet end 206 and opposing outlet end 208. The combustion system 200 also comprises a set of main fuel injectors 210 that are positioned radially outward of the combustion liner 204 and proximate an upstream end of the flow sleeve 202. The set of main fuel injectors 210 direct a controlled amount of fuel into the passing air stream to provide a fuel-air mixture for the combustion system 200.

For the embodiment of the present invention shown in FIG. 2, the main fuel injectors 210 are located radially outward of the combustion liner 204 and spread in an annular array about the combustion liner 204. The main fuel injectors 210 are divided into two stages with a first stage extending approximately 120 degrees about the combustion liner 204 and a second stage extending the remaining annular portion, or approximately 240 degrees, about the combustion liner 204. The first stage of the main fuel injectors 210 are used to generate a Main 1 flame while the second stage of the main fuel injectors 210 generate a Main 2 flame.

Figure 3:
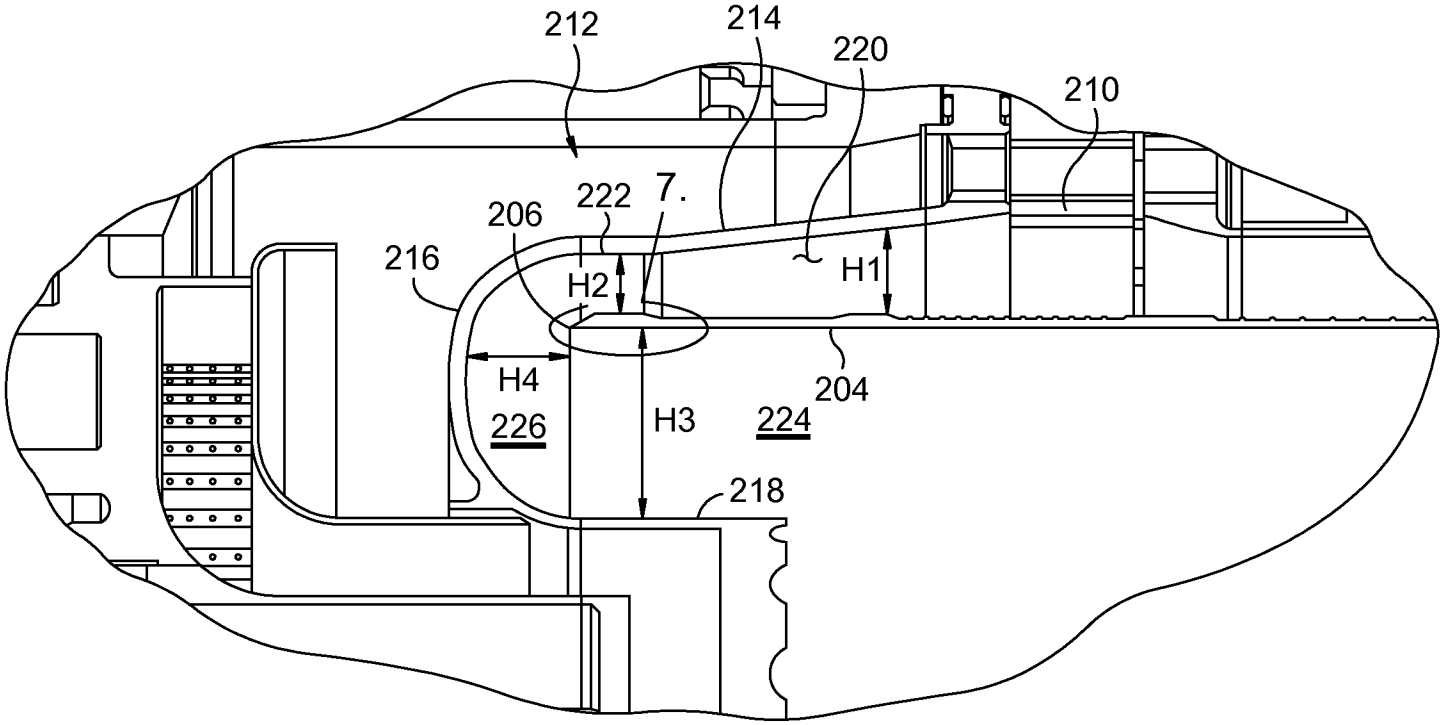
FIG. 3 is a detailed cross section of a portion of the gas turbine combustor of FIG. 2 in accordance with an embodiment of the present invention.
Figure 4B:
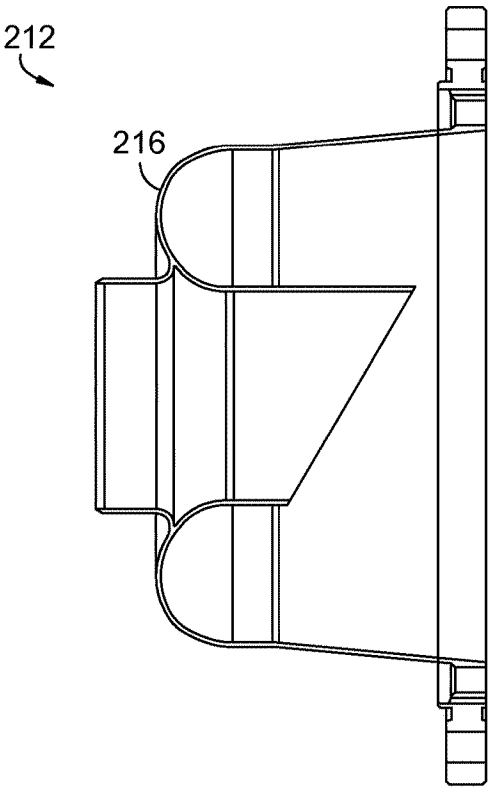
FIG. 4B is a cross section view of a dome assembly in accordance with an alternate embodiment of the present invention.
Figure 4A:
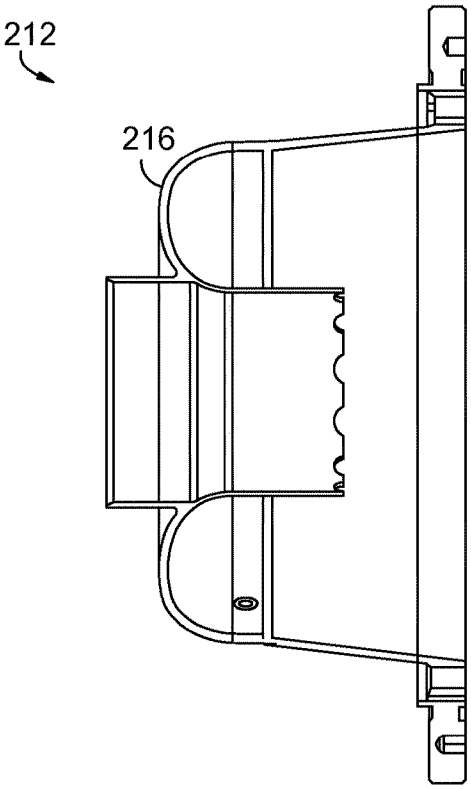
FIG. 4A is a cross section view of a dome assembly in accordance with an embodiment of the present invention.

The combustion system 200 also comprises a combustor dome assembly 212, which, as shown in FIGS. 2 and 3, encompasses the inlet end 206 of the combustion liner 204. More specifically, the dome assembly 212 has an outer annular wall 214 that extends from proximate the set of main fuel injectors 210 to a generally hemispherical-shaped cap 216, which is positioned a distance forward of the inlet end 206 of the combustion liner 204. The dome assembly 212 turns through the hemispherical-shaped cap 216 and extends a distance into the combustion liner 204 through a dome assembly inner wall 218.

As a result of the geometry of the combustor dome assembly 212 in conjunction with the combustion liner 204, a series of passageways are formed between parts of the combustor dome assembly 212 and the combustion liner 204. A first passageway 220 is formed between the outer annular wall 214 and the combustion liner 204. Referring to FIG. 3, a first passageway 220 tapers in size, from a first radial height H1 proximate the set of main fuel injectors 210 to a smaller height H2 at a second passageway 222. The first passageway 220 tapers at an angle to accelerate the flow to a target threshold velocity at a location H2 to provide adequate flashback margin. That is, when velocity of a fuel-air mixture is high enough, should a flashback occur in the combustion system, the velocity of the fuel-air mixture through the second passageway will prevent a flame from being maintained in this region.

The second passageway 222 is formed between a cylindrical portion of the outer annular wall 214 and the combustion liner 204, proximate the inlet end 206 of the combustion liner and is in fluid communication with the first passageway 220. The second passageway 222 is formed between two cylindrical portions and has a second radial height H2 measured between the outer surface of the combustion liner 204 and the inner surface of the outer annular wall 214. The combustor dome assembly 212 also comprises a third passageway 224 that is also cylindrical and positioned between the combustion liner 204 and inner wall 218. The third passageway has a third radial height H3, and like the second passageway, is formed by two cylindrical walls—combustion liner 204 and dome assembly inner wall 218.

As discussed above, the first passageway 220 tapers into the second passageway 222, which is generally cylindrical in nature. The second radial height H2 serves as the limiting region through which the fuel-air mixture must pass. The radial height H2 is regulated and kept consistent from part-to-part by virtue of its geometry, as it is controlled by two cylindrical (i.e. not tapered) surfaces, as shown in FIG. 3. That is, by utilizing a cylindrical surface as a limiting flow area, better dimensional control is provided because more accurate machining techniques and control of machining tolerances of a cylindrical surface is achievable, compared to that of tapered surfaces. For example, it is well within standard machining capability to hold tolerances of cylindrical surfaces to within +/−0.001 inches.

Utilizing the cylindrical geometry of the second passageway 222 and third passageway 224 provides a more effective way to control and regulate the effective flow area and controlling the effective flow area allows for the fuel-air mixture to be maintained at predetermined and known velocities. By being able to regulate the velocity of the mixture, the velocity can be maintained at a rate high enough to ensure flashback of the flame does not occur in the dome assembly 212.

One such way to express these critical passageway geometries shown in FIGS. 2-4B is through a turning radius ratio of the second passageway height H2 relative to the third passageway height H3. That is, the minimal height relative to the height of the combustion inlet region. For example, in the embodiment of the present invention depicted herein, the ratio of H2/H3 is approximately 0.32. This aspect ratio controls the size of the recirculation and stabilization trapped vortex that resides adjacent to the liner, which effects overall combustor stability. For example, for the embodiment shown in FIGS. 2 and 3, utilizing this geometry permits velocity of the fuel-air mixture in the second passageway to remain within a range of approximately 40-80 meters per second. However, the ratio can vary depending on the desired passageway heights, fuel-air mixture mass flow rate and combustor velocities. For the combustion system disclosed, the ratio of H2/H3 can range from approximately 0.1 to approximately 0.5. More specifically, for an embodiment of the present invention, the first radial height H1 can range from approximately 15 millimeters to approximately 50 millimeters, while the second radial height H2 can range from approximately 10 millimeters to approximately 45 millimeters, and the third radial height H3 can range from approximately 30 millimeters to approximately 100 millimeters.

As discussed above, the combustion system also comprises a fourth passageway 226 having a fourth height H4, where the fourth passageway 226 is located between the inlet end 206 of the combustion liner and the hemispherical-shaped cap 216. As it can be seen from FIG. 3, the fourth passageway 226 is positioned within the hemispherical-shaped cap 216 with the fourth height measured along the distance from the inlet end 206 of the liner to the intersecting location at the hemispherical-shaped cap 216. As such, the fourth height H4 is greater than the second radial height H2, but the fourth height H4 is less than the third radial height H3. This relative height configuration of the second, third and fourth passageways permits the fuel-air mixture to be controlled (at H2), turn through the hemispherical-shaped cap 216 (at H4) and enter the combustion liner 204 (at H3) all in a manner so as to ensure the fuel-air mixture velocity is fast enough that the fuel-air mixture remains attached to the surface of the dome assembly 212, as an unattached, or separated, fuel-air mixture could present a possible condition for supporting a flame in the event of a flashback.

As it can be seen from FIG. 3, the height of the first passageway 220 tapers as a result, at least in part, of the shape of outer annular wall 214. More specifically, the first passageway 220 has its largest height at a region adjacent the set of main fuel injectors 210 and its minimum height at the region adjacent the second passageway. Alternate embodiments of the dome cap assembly 212 having the passageway geometry described above are shown in better detail in FIGS. 4A and 4B.

Figure 5:
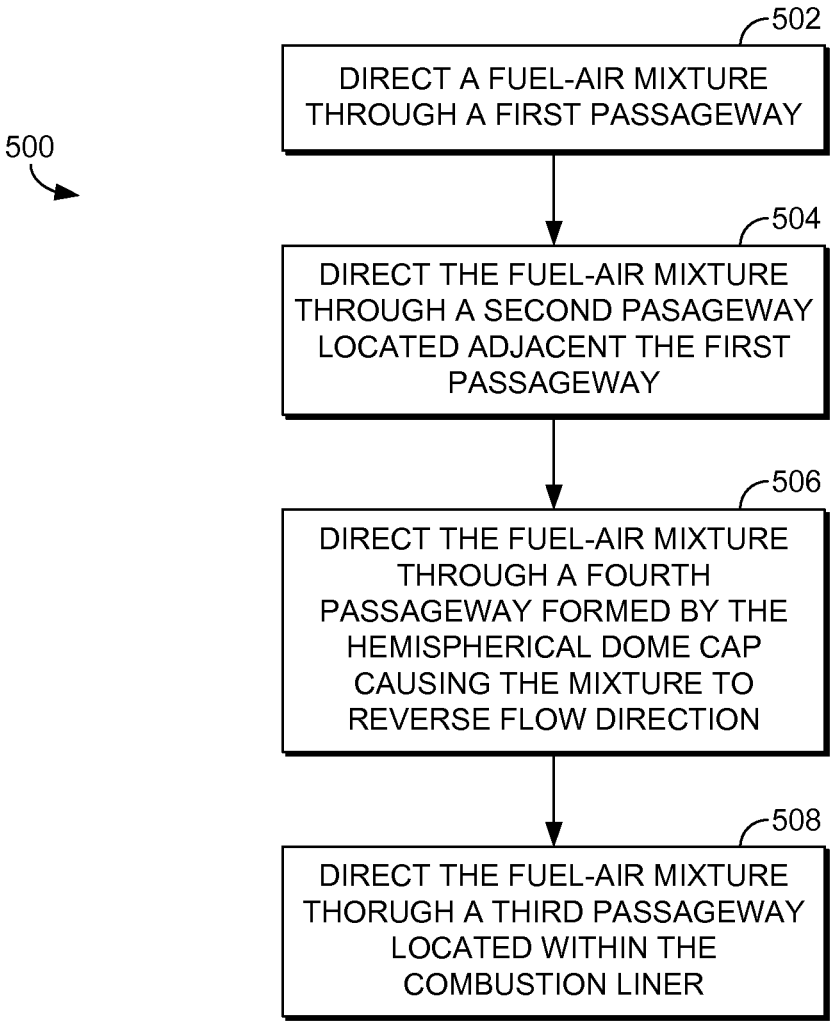
FIG. 5 is a flow diagram disclosing a process of regulating the fuel-air mixture entering a gas turbine combustor.

Turning to FIG. 5, a method 500 of controlling a velocity of a fuel-air mixture for a gas turbine combustor is disclosed. The method 500 comprises a step 502 of directing a fuel-air mixture through a first passageway that is located radially outward of a combustion liner. Then, in a step 504, the fuel-air mixture is directed from the first passageway and into a second passageway that is also located radially outward of the combustion liner. In a step 506, the fuel-air mixture is directed from the second passageway and into the fourth passageway formed by the hemispherical dome cap 216. As a result, the fuel-air mixture reverses its flow direction to now be directed into the combustion liner. Then, in a step 508, the fuel-air mixture is directed through a third passageway located within the combustion liner such that the fuel-air mixture passes downstream into the combustion liner.

As one skilled in the art understands, a gas turbine engine typically incorporates a plurality of combustors. Generally, for the purpose of discussion, the gas turbine engine may include low emission combustors such as those disclosed herein and may be arranged in a can-annular configuration about the gas turbine engine. One type of gas turbine engine (e.g., heavy duty gas turbine engines) may be typically provided with, but not limited to, six to eighteen individual combustors, each of them fitted with the components outlined above. Accordingly, based on the type of gas turbine engine, there may be several different fuel circuits utilized for operating the gas turbine engine. The combustion system 200 disclosed in FIGS. 2 and 3 is a multi-stage premixing combustion system comprising four stages of fuel injection based on the loading of the engine. However, it is envisioned that the specific fuel circuitry and associated control mechanisms could be modified to include fewer or additional fuel circuits.

Figure 6:
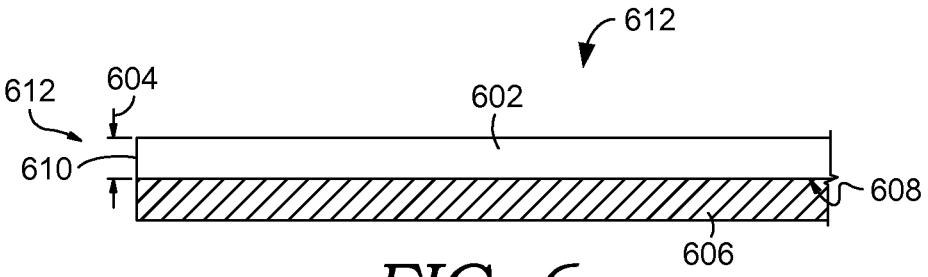
FIG. 6. PRIOR ART
FIG. 6 is a cross section view of a portion of a combustion liner in accordance with the prior art.

Referring now to FIGS. 6-11, additional details regarding an aspect of the combustion liner inlet region are depicted and discussed. Turning first to FIG. 6, a detailed view of the inlet end of a combustion liner of the prior art is shown. More specifically, a combustion liner 600 has a generally annular body 602 with a thickness 604 and a thermal barrier coating 606 applied along an inner surface 608 of the generally annular body 602. The combustion liner 600 has an inlet end 610. In this prior art embodiment, the thermal barrier coating 606 extends to the inlet end 610, and together forms a blunt face 612. That is, for an embodiment of the prior art, the inlet end 610 has a combined thickness (metal+thermal barrier coating) upwards of 0.090 inches or greater, depending on the sheet metal thickness used for the combustion liner 600. When such a combustion liner 600 is used in conjunction with a combustion system of FIGS. 2-5, the combustion liner 600 and its inlet end 610 form a bluff body that can yield undesirable results when the flow of fuel and air pass along and around the inlet end 610. More specifically, as the flow of fuel and air pass around the inlet end 610, the fuel and air mixture tends to separate as it enters the combustion liner 600 due to the bluff body geometry. As one skilled in the art understands, flow separation such as this can help to anchor a flame at or near the inlet end 610. This undesirable result causes the inlet end 610 of the combustion liner 600 to be eroded by the flame formed in this area of recirculation resulting in premature repair or replacement to the combustion liner.

Figure 7:
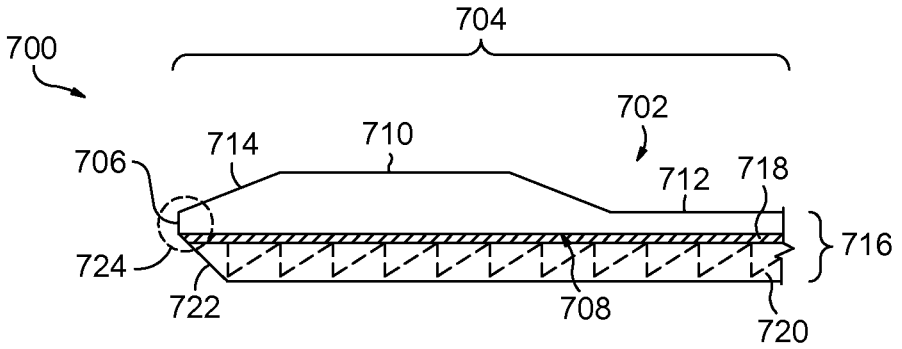
FIG. 7 is a cross section view of a portion of a combustion liner in accordance with an embodiment of the present invention.

Improvements to the inlet end 610 of the prior art combustion liner are depicted in FIG. 7. In an embodiment of the present invention, a combustion liner 700 is provided having a generally annular body 702 having a thickness T that varies towards a forward region 704. The combustion liner 700 also has an inlet end 706 and an opposing outlet end (not shown). The generally annular body 702 also has an inner surface 708 and an opposing outer surface having a contoured profile proximate the inlet end 706 comprising a first outer surface 710 and a second outer surface 712 where the first outer surface 710 is located radially outward of the second outer surface 712.

The forward region 704 of the combustion liner 700 also has a first chamfer 714 extending from the first outer surface 710 towards the inlet end 706, thereby reducing the thickness of the combustion liner 700 in the forward region 704. For the embodiment depicted in FIG. 7, the first chamfer 714 is oriented at approximately a 5-75 degree angle and reduces the thickness of the combustion liner 700 from approximately 0.1-0.25 inches to approximately 0.005-0.1 inches at the inlet end 706. The chamfer angle, resulting thickness, and rate of change for the thickness of the combustion liner are merely representative and not meant to be limiting the scope of the present invention. As one skilled in the art will understand, the thickness of the combustion liner, chamfer angle, and rate of thickness change towards the inlet end 706 can vary. However, by tapering the thickness change via first chamfer 714 at a first rate, more of the flow of fuel and air passing along the outer surface of the generally annular body 702 remains attached to the annular body 702 as opposed to prior art designs.

The combustion liner 700 also comprises a coating 716 applied to the inner surface 708 of the generally annular body 702. One such coating utilized for the combustion liner 700 is a thermal barrier coating. The thermal barrier coating 716 applied to the inner surface 708 comprises a bond coating 718 and a ceramic top coating 720. For example, the bond coating 718 can be applied approximately 0.001-0.010 inches thick, while the ceramic top coating 720 can be applied approximately 0.010-0.200 inches thick over the bond coating 718. As one skilled in the art understands, the thermal barrier coating can be a standard commercial coating discussed above or can also be a more advanced thermal barrier coating such as a dense vertically cracked coating. As it can be seen from FIG. 7, a portion of the coating proximate the inlet end 706 is tapered via a second chamfer 722 oriented at an angle of 5-75 degrees, which tapers the coating thickness towards the inlet end 706 at a second rate. The second chamfer 722 can be formed via a machining process, such as grinding to a previously-applied coating, or it can be formed as a result of tapering the layers of bond coating and thermal barrier coating applied.

Therefore, as it can be seen by FIG. 7, the first chamfer 714 and the second chamfer 722 form a reduced bluff body region 724 at the inlet end 706. In an embodiment of the present invention, the reduced bluff body region 724 has a thickness of approximately 0.020 inches. However, other reduced bluff body regions 724 can be utilized depending on the desired configuration of the combustion liner 700. As discussed above, a bluff body region creates a recirculation zone. However, the chamfer angles 714 and 722 of the present invention reduce the size of such a region so as to reduce the tendency for the flow of fuel and air to separate as it passes towards the inlet end 706.

However, with the reduced bluff body region 724 formed by the present invention, the flow of fuel and air passing along the outer region of the generally annular body 702 remains along the tapered surfaces 714 and 722, thereby reducing the adverse effect of the bluff body of the prior art.

Figure 8:
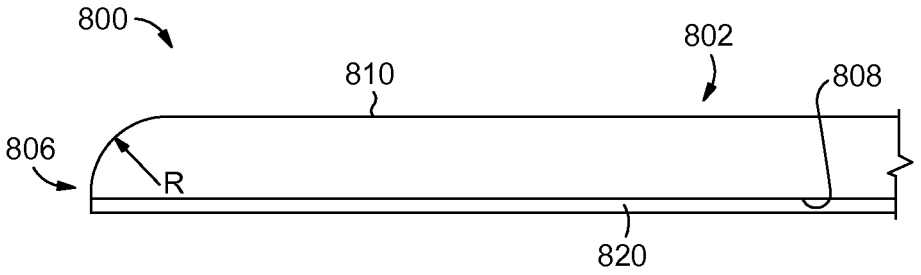
FIG. 8 is a cross section view of a portion of a combustion liner in accordance with an alternate embodiment of the present invention.
Figure 9:
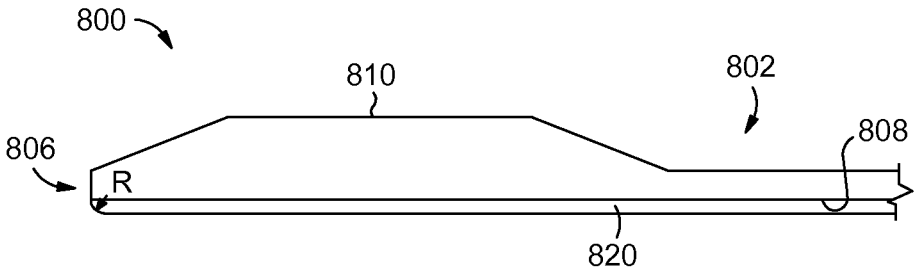
FIG. 9 is a cross section view of a portion of a combustion liner in accordance with yet another alternate embodiment of the present invention.
Figure 10:
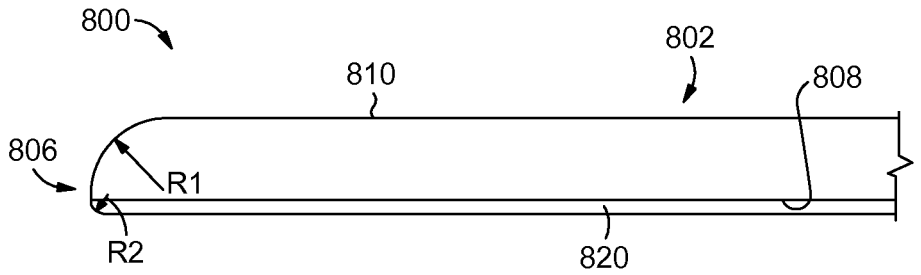
FIG. 10 is a cross section view of a portion of a combustion liner in accordance with another embodiment of the present invention.

In an alternate embodiment of the present invention, the chamfer at the liner inlet end 706 may instead comprise a rounded bluff body region or a rounded portion of the liner inlet end as shown in FIGS. 8-10. More specifically, and as shown in FIGS. 8-10, a combustion liner 800 has an inlet end 806 and instead of the chamfer angles 714 and 722 shown in FIG. 7, the combustion liner 800 has one or more radii at the inlet end 806. That is, the combustion liner 800 comprises a generally annular body 802 with an inlet end 806 and an outlet end (not shown). The annular body 802 has an inner surface 808 and an outer surface 810. In this embodiment, the inner surface 808 has a thermal barrier coating 820 applied thereto. However, unlike the embodiment of FIG. 7, this embodiment includes one or more radii formed into the combustion liner 800 at the liner inlet. More specifically, in FIG. 8, the one or more radii comprise a radius R to the generally annular body 802 about the outer surface 810 proximate inlet end 806. Radius R can vary depending on a variety of factors. However, it is preferred that radius R extends a distance so as to extend generally equivalent to the length of the tapered surface 714 of the embodiment in FIG. 7. AS such, the radius R covers the same general region of the tapered surface 714. However, while a radius provides a similar benefit to that of the tapered surface 714, it is not as advantageous as the tapered surface 714. The radius R increases the risk of separation of the air flow as a result of the curved surface. Also, such a radius negatively affects any flame holding in the area.

Alternatively, and as shown in FIG. 9, the one or more radius R to the combustion liner 800 can be formed along the thermal barrier coating 820 applied to the inner surface 808 at the inlet end 806. The radius R of the thermal barrier coating 820 can vary depending on the coating thickness. As with the embodiment of FIG. 8, the radius R to the thermal barrier coating also negatively affects flame holding in the inlet end 806.

Then, referring to FIG. 10, the one or more radii R can comprise a first radius R1 and a second radius R2. More specifically, the generally annular body 802 has a first radius R1 that is generally greater than the radius R2 of the thermal barrier coating 820. As such, the combination of R1 and R2 at the inlet end 806 forms a shape comparable to a bullnose at the inlet to the combustion liner.

The configurations disclosed in FIGS. 8-10 provide a blunt front edge of the combustion liner that is necessary for the liner structural integrity. However, reducing the front edge thickness prevents premature thermal wear of the combustion liner inlet end 806 by reducing the tendency for flame holding. The radii R, R1 and/or R2 are formed preferably by a grinding process to the liner and/or thermal barrier coating.

Figure 11:
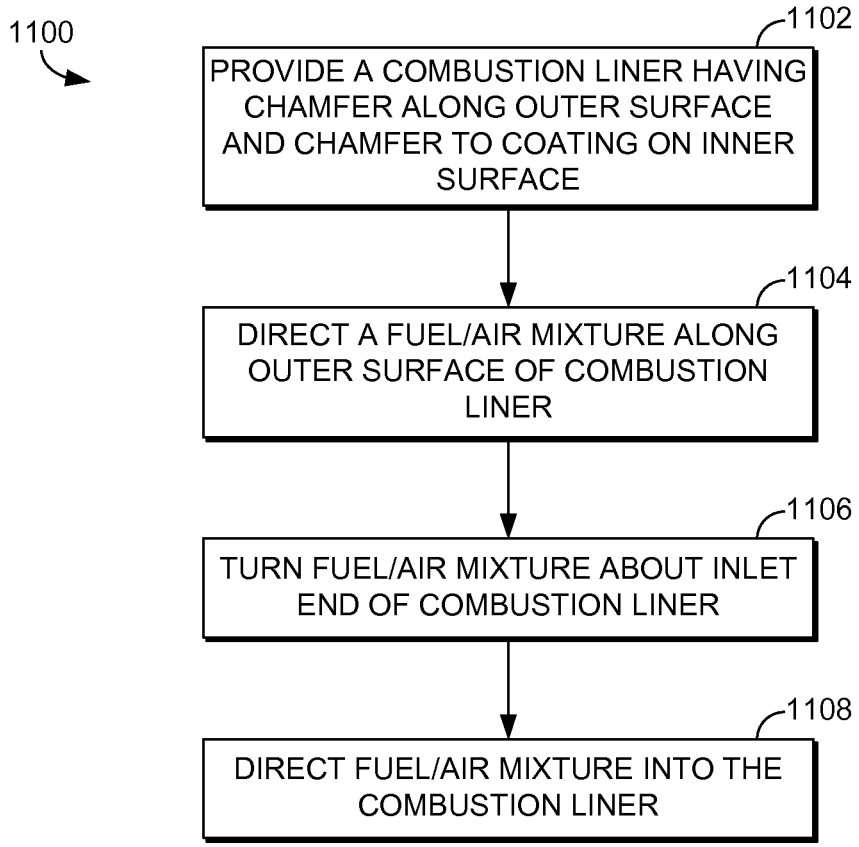
FIG. 11 is a flow diagram depicting a process for directing a fuel and air mixture into a combustion liner in accordance with an embodiment of the present invention.

Referring now to FIG. 11, a method 1100 of reducing a recirculation zone in a gas turbine combustor is disclosed. More specifically, in a step 1102, a combustion liner is provided having a chamfer along an outer surface of the combustion liner, a coating applied to an inner surface of the combustion liner, and a chamfer to the coating on the inner surface. Then, in a step 1104, a fuel and air mixture is directed along the outer surface of the combustion liner. The fuel and air mixture is then turned about an inlet end of the combustion liner in a step 1106, such that the mixture remains at least in close proximity to the chamfered portions of the combustion liner. Then, in a step 1108, the fuel and air mixture is directed into the combustion liner where it is ignited to supply power to the gas turbine engine.

While the invention has been described in what is known as presently the preferred embodiment, it is to be understood that the invention is not to be limited to the disclosed embodiment but, on the contrary, is intended to cover various modifications and equivalent arrangements within the scope of the following claims. The present invention has been described in relation to particular embodiments, which are intended in all respects to be illustrative rather than restrictive.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. A combustion liner comprising:

a generally annular body having an inlet end and an opposing outlet end, the generally annular body having an inner surface facing a combustion chamber and an opposing outer surface, the outer surface having a contoured profile proximate the inlet end such that the outer surface comprises a first outer surface portion and a second outer surface portion with the first outer surface portion located radially outward of the second outer surface portion and a first chamfer extending from the first outer surface portion to the inlet end; and, a coating applied to the inner surface, where the coating comprises a bond coating and a ceramic top coating, at least a portion of the coating proximate the inlet end having a second chamfer opposed to the first chamfer and extending to the inlet end, the second chamfer thereby tapering a coating thickness towards the inlet end.

2. The combustion liner of claim 1, wherein a thickness of the first outer surface portion is greater than a thickness of the second outer surface portion.

3. The combustion liner of claim 1, wherein the first chamfer and the second chamfer form a reduced bluff body region at the inlet end.

4. The combustion liner of claim 3, wherein the bluff body at the inlet end provides for a recirculation zone proximate the inlet end of the combustion liner.

5. The combustion liner of claim 1, wherein the first chamfer has a chamfer angle from the first outer surface portion of the liner between approximately 5 degrees and 75 degrees to reduce risk of separation of airflow moving towards the inlet end.

6. The combustion liner of claim 1, wherein the coating applied to the inner surface of the combustion liner has a dense vertically cracked microstructure.

7. An inlet portion of a combustion liner comprising:

a generally annular body having a first portion with a first liner thickness, a second portion with a second liner thickness different from the first liner thickness, and a third portion extending from the first portion to an inlet end of the combustion liner and having a thickness tapering at a first rate; and, a coating applied to an inner wall of the generally annular body, the inner wall being a surface of the combustion liner facing a combustion chamber, wherein at least a portion of the coating at the inlet end that is opposed to the third portion has a thickness that tapers at a second rate from a first coating thickness to a second coating thickness.

8. The inlet portion of claim 7, wherein the inlet end has a thickness of approximately 0.005-0.100 inches.

9. The inlet portion of claim 7, wherein the thickness of the combustion liner tapers at an angle of approximately 5-75 degrees relative to an outermost surface of the first portion.

10. The inlet portion of claim 7, wherein the thickness of the coating tapers at an angle of approximately 5-75 degrees relative to an inner surface of the coating at a location of the coating having the first coating thickness.

11. The inlet portion of claim 7, wherein the coating has a dense vertically cracked microstructure.

12. The inlet portion of claim 7, wherein the first coating thickness is approximately 0.010 inches to 0.200 inches.

13. A method of reducing a recirculation zone in a combustion liner comprising:

providing a combustion liner having a first chamfer along an outer surface of the combustion liner extending to an inlet end of the combustion liner, providing a coating applied to an inner surface of the combustion liner, the inner surface being a surface of the combustion liner facing a combustion chamber, and providing a second chamfer to at least a portion of the coating on the inner surface that is opposed to the first chamfer and that extends to the inlet end of the combustion liner;

directing a fuel and air mixture along the outer surface of the combustion liner;

turning the fuel and air mixture about the inlet end of the combustion liner such that the mixture remains at least in close proximity to the chamfered portions of the combustion liner; and, directing the mixture into the combustion liner.

14. The method of claim 13, wherein the inlet end forms a bluff body having a reduced thickness compared to the remainder of the combustion liner and the coating.

15. The method of claim 14, wherein the bluff body has a thickness of approximately 0.005-0.050 inches.

16. A combustion liner comprising:

a generally annular body having a thickness, an inlet end, and an opposing outlet end, the generally annular body having an inner surface facing a combustion chamber and an opposing outer surface, a portion of the outer surface contoured according to a first radius at the inlet end; and a coating applied to the inner surface, where the coating comprises a bond coating and a ceramic to coating, at least a portion of the coating at the inlet end that is opposed to the portion of the outer surface contoured according to the first radius contoured according to a second radius, such that the first radius blends into the second radius at the inlet end.

17. The combustion liner of claim 16, wherein the first radius is tangential to the second radius.

18. The combustion liner of claim 16, wherein the first radius is greater than the second radius.

19. The combustion liner of claim 16, wherein the second radius is greater than the first radius.

20. A combustion liner comprising:

a generally annular body having thickness, an inlet end, and an opposing outlet end, the generally annular body having an inner surface facing a combustion chamber and an opposing outer surface, the outer surface having a contoured profile proximate the inlet end such that the outer surface comprises a first outer surface portion and a second outer surface portion with the first outer surface portion located radially outward of the second outer surface portion and a first chamfer extending from the first outer surface portion to the inlet end; and, a coating applied to the inner surface, where the coating comprises a bond coating and a ceramic top coating, at least a portion of the coating proximate the inlet end and opposed to the first chamfer having a radius at the inlet end.

21. A combustion liner comprising:

a generally annular body having a thickness, an inlet end, and an opposing outlet end, the generally annular body having an inner surface facing a combustion chamber and an opposing outer surface, a portion of the outer surface contoured according to a radius at the inlet end; and a coating applied to the inner surface, where the coating comprises a bond coating and a ceramic top coating, at least a portion of the coating proximate the inlet end having a chamfer opposed to the portion of the outer surface contoured according to the radius and extending to the inlet end, the chamfer thereby tapering a coating thickness towards the inlet end.

* * * * *